United States Patent [19]

Stenstrom

[11] 4,154,405

[45] May 15, 1979

[54] NOZZLE FOR DELIVERING A TRANSVERSALLY CONTAINED JET OF LIQUID

[75] Inventor: Borje H. Stenstrom, Enebyberg, Sweden

[73] Assignee: Salen & Wicander Aktiebolag, Sweden

[21] Appl. No.: 764,098

[22] Filed: Jan. 31, 1977

Related U.S. Application Data

[63] Continuation-in-part of Ser. No. 704,280, Jul. 12, 1976, abandoned.

[51] Int. Cl.[2] ..... B05B 1/02

[52] U.S. Cl. ..... 239/590.3

[58] Field of Search ..... 239/471, 472, 589-590.5, 239/427, 428.5

[56] References Cited

U.S. PATENT DOCUMENTS

| | | | |
|---|---|---|---|
| 1,983,634 | 12/1934 | Nichols | 239/590 X |

FOREIGN PATENT DOCUMENTS

| | | | |
|---|---|---|---|
| 504897 | 7/1920 | France | 239/590.5 |
| 865717 | 5/1941 | France | 239/428.5 |
| 78386 | 6/1962 | France | 239/427 |
| 190878 | 8/1964 | Sweden | 239/427 |
| 452357 | 8/1936 | United Kingdom | 239/590 |
| 677793 | 8/1952 | United Kingdom | 239/590.3 |
| 797315 | 7/1958 | United Kingdom | 239/427 |

*Primary Examiner*—Robert B. Reeves
*Assistant Examiner*—Andres Kashnikow
*Attorney, Agent, or Firm*—Pollock, Vande Sande & Priddy

[57] ABSTRACT

A nozzle for delivering a liquid jet, especially water for cleaning or fire-fighting purposes, is designed so as to counteract rapid split-up of the jet in directions transverse to its trajectory. The jet is divided into a central core and a surrounding jacket by a tubular member causing an increase of the ratio between the cross-sectional areas of the core and the jacket. The transverse containment of the jet is enhanced by an outlet portion of the nozzle located downstream of the tubular member and converging in the flow direction of the jet.

7 Claims, 4 Drawing Figures

Fig. 1
PRIOR ART
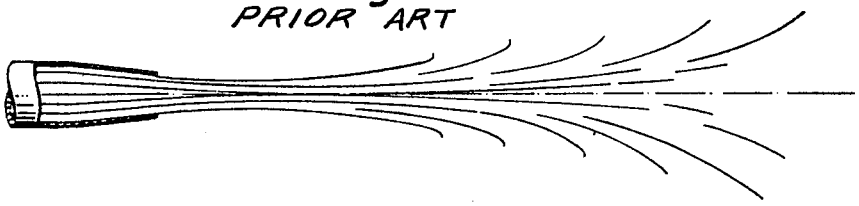
Fig. 2
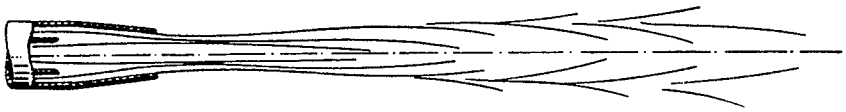
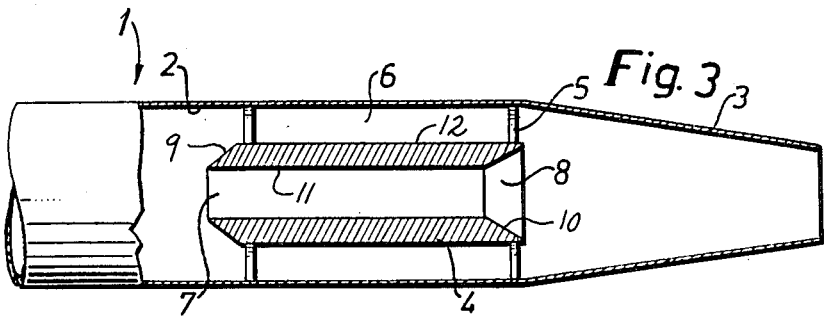
Fig. 3

NOZZLE FOR DELIVERING A TRANSVERSALLY CONTAINED JET OF LIQUID

This is a continuation-in-part of prior copending application Ser. No. 704,280, filed July 12, 1976, now abandoned.

In the use of nozzles delivering jets of liquid, normally water, it is as a rule desireable to maintain the cross-section of the jet substantially constant along a considerable distance from the outlet orifice of the nozzle. The reason behind this desideratum is, of course, that when the jet hits its target it should, to the extent possible, have the same cross-sectional profile as immediately after leaving the nozzle. By way of example, such nozzles are used in fire-extinguishers and in apparatus for cleaning oil tanks, especially aboard ships. If the jet can be transversely contained the corresponding result is not only facilitated aiming but also increased impact and longer range.

However, prior art nozzles do only very insignificantly satisfy the requirement above discussed. As is well-known, a liquid jet delivered by a nozzle tends to diverge so that the cross-sectional area of the jet is successively increased so that, at a large distance from the nozzle, the original jet is no longer transversely contained but has been transformed into a multiplicity of separate smaller jets. Efforts have been made to counteract this diverging tendency by the use of relatively long nozzles. The underlying theory has been that if the liquid flowing inside the nozzle is shaped like a column of uniform cross-section it should retain that cross-section also after being delivered by the nozzle. This theory does, however, not work out in practice.

It also belongs to the art to use a nozzle the portion of which located immediately upstream the outlet orifice converges conically. The theory behind this layout was twofold. First, it was presumed that the gradual restriction of the effective cross-sectional area would increase the flow velocity which result naturally materialized. Second, it was hoped that the conical shape of the outlet portion of the nozzle would impart to the circumferential portion of the jet a radially inwards directed component capable of maintaining the jet transversely contained also after its passage through the outlet orifice. The latter result did, however, not materialize, at least not significantly.

The present invention is based on the realization that the real ground of the problem above discussed is the following one. As soon as the jet has been delivered from the nozzle and entered the surrounding air its velocity is reduced due to the fact that the circumferential portion of the jet is decelerated because of friction generated by the surrounding air particles. In contrast thereto, the central portion of the jet, the core, is naturally protected against the influence of such decelerating frictional forces, at least at distances not too far away from the outlet orifice. At any rate, the final result will be that the jet core travels at a higher speed than the surrounding circumferential portion. The latter is accordingly gradually decelerated and divided into free liquid particles, whereby the annular layer inside that outermost portion is in turn brought into contact with the air and decelerated etc. In this way the containment and speed of the jet diminishes at an accelerating rate.

A nozzle according to the present invention comprises means imparting to the jet such a transversal speed distribution that, before the jet leaves the outlet of the nozzle, its circumferential portion is subjected to a higher dynamic pressure than its central portion. The means creating the transversally oriented speed gradient comprises a pipe dimensioned and mounted in such a way relative to the inner walls of the nozzle proper that the ratio between the effective cross sectional areas of the jet core and the circumferential portion of the jet increases step-wise in the direction of flow.

The outer surface of the inlet end of the pipe is sloped to form a surface which, looking in the direction of flow, diverges outwardly from the inner wall of the pipe at an angle of about 15 to 45 degrees. This increases the aforementioned ratio in a first step. The inner surface of the outlet end of the pipe is sloped to form a surface which, also looking in the direction of the flow, diverges outwardly from the inner wall of the pipe at an angle of about 15 to 45 degrees. This increases said ratio in a second step. If the nozzle has a converging outlet portion, that portion may to a greater or lesser extent cooperate with the inner pipe for achieving maximum jet exit velocity.

FIG. 1 shows a longitudinal section through a liquid jet delivered by a conventional nozzle. For the purpose of illustration the divergence of the jet has been exaggerated.

FIG. 2 corresponds to FIG. 1 but illustrates a jet delivered by a nozzle according to the invention.

FIG. 3 illustrates a preferred embodiment of the invention.

Figure 4:
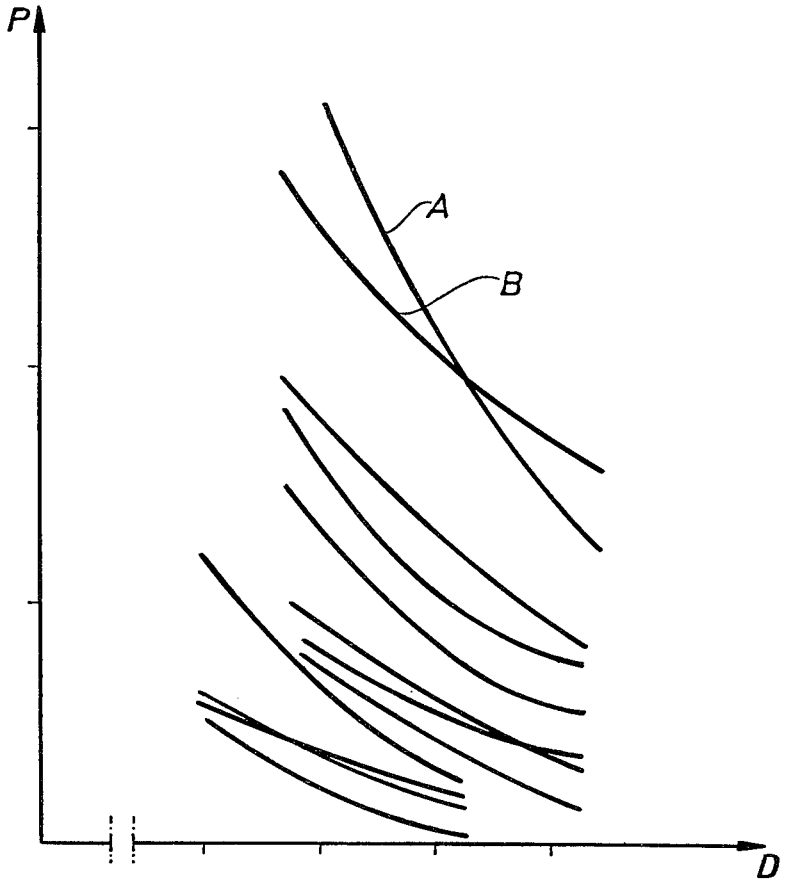
FIG. 4 is a diagram showing the result of comparative tests carried out with nozzles according to the invention and several prior art nozzles.

It is not necessary to comment further upon FIGS. 1 and 2.

In FIG. 3 reference numeral 1 designates a nozzle comprising a rear cylindrical portion 2 and a front conical outlet portion 3. Inside the nozzle there is a coaxially mounted pipe 4 supported by a number of spoke-like arms 5 which are thin in the circumferential direction of the nozzle.

In the embodiment shown in FIG. 3, substantially all of pipe 4 is located inside the cylindrical nozzle portion 2. During its passage through that portion the liquid jet will accordingly be literally split into a central core and a surrounding jacket of annular cross section. At the inlet end 7 of pipe 4 is outwardly diverging sloped surface 9, which preferably has a sharp edge that intersects with the inner pipe surface 11. This sloped surface increases the jacket velocity after the core and jacket streams part from one another. A typical amount of jacket area decrease in this step would be about 10%, which percentage may vary in the range of from about 5 to about 20%.

At the outlet end 8 of pipe 4 is outwardly diverging sloped surface 10, which preferably has a sharp edge that intersects with the outer pipe surface 12. The second sloped surface decreases the core velocity just before the core and jacket streams recombine. A typical amount of core area increase in this step would be about 18%, which percentage may vary in the range of from about 10 to about 30%. The total percentage change in the two steps should be about 40% or less.

The initial increase in the jacket velocity by surface 9 at the inner tube inlet and the decrease in the core velocity by the surface 10 at the inner tube outlet represent two steps, and in each case the ratio of core velocity to jacket velocity decreases. Thus, there is a step-wise change in the ratio between the dynamic pressures of the jacket and the core at the ends of the inner tube. When the two branch flows of the jet enter the conical outlet portion 3 they exhibit a radial speed gradient because the jacket portion has a higher speed than the core portion. That gradient is maintained when the velocities of the core and jacket streams are increased by the converging shape of the outlet portion.

The sloped surfaces 9 and 10 may be formed in any suitable manner, such as by casting them integral with the inner tubular member, or by forming them on a prefabricated tube, such as by rolling, cutting, or grinding. Such surfaces may be referred to as chamfers, although they need not necessarily be flat when viewed in cross section, so long as their shape provides a relatively smooth transition which tends to discourage turbulence and cavitation.

There does not appear to be any maximum length of the inner tube beyond which the invention is inoperative. However, there are certain dimensional tolerances which should be observed, including the minimum length of the inner tube, if one is to obtain the advantages of the invention. The inner tube should be sufficiently long to substantially suppress turbulence in the core stream. In general, the ratio of the outer diameter of the inner tube to the inner diameter of the outer tube will be in the range of about 0.6 to about 0.8, with a ratio of about 0.65 being preferred. Also, the ratio of the wall thickness of the inner tube to the inner diameter of the outer tube will generally be in the range of about 0.02 to about 0.04, with a ratio of about 0.025 being preferred. In general, the ratio of the core area to the jacket area intermediate the ends of the inner tube should fall in the range of about 0.5 to about 2, with a ratio of about 0.7 being preferred. Giving due regard to the foregoing parameters, the remaining dimensions of the nozzle are selected based on criteria normally used by persons skilled in the art. In the practical working of the invention it is naturally possible to modify the general layout of the nozzle. However, the nozzle should have such a configuration that the jacket portion of the jet is subjected to a higher exit velocity than the central core of the jet for the purpose of compensating, at least partially, the speed reduction which the circumferential portion of the jacket suffers, firstly because of friction against the inner wall of the nozzle and secondly due to friction against the surrounding air.

The diagram in FIG. 4 shows the dynamic pressure P of the jet as a function of the distance D from the outlet orifice of a number of nozzles. Curves A and B relate to nozzles designed according to the present invention, whereas the family of curves shown below illustrates the results of tests with prior art nozzles. It appears clearly from the diagram that application of the invention involves a marked improvement. By way of example, compare curve B with the top one in the prior art curve family. The last-mentioned curve does accordingly represent a top performance prior art nozzle. The comparison shows that at a given distance from the nozzle outlet curve B indicates a dynamic pressure, or impact, approximately 50% higher than that corresponding to the prior art nozzle curve.

EXAMPLES

While passing water at 8 KG per square CM pressure through a nozzle in the various modified forms below, the effective jet areas of the resultant jet was measured 10 meters from the nozzle outlet. Each modification used the same outer tube and nozzle tip, configured substantially as in FIG. 3, the outer tube diameter being 65 MM and the nozzle tip converging to an opening of 40 MM over a length of 165 MM. The dimensions of the inner tubes of examples 1–5 were: Length 200 MM, outer diameter 43 MM, and wall thickness, 1.5 MM, the other characteristics of the inner tubes being set forth below.

| Example Number | Inner Tube Characteristic | Effective Jet Area Square CM |
|---|---|---|
| 1 | Symmetrically chamfered ends | 1140 |
| 2 | As shown in Fig. 3, with 45 degree chamfer at each end | 165 |
| 3 | Same as Example 2 but with tube reversed end for end to give decreasing core/jacket area ratio | 1140 |
| 4 | Same as Example 2 but with 15 degree chamfers | 135 |
| 5 | Same as Example 4 with tube reversed end for end | 2550 |
| 6 | No inner tube | about 4000 |

What is claimed is:

1. A nozzle for discharging a jet of liquid with a radial speed gradient characterized by a radially outward portion of the jet having a greater longitudinal velocity than a radially inward portion of said jet, said nozzle comprising a discharge outlet, an outer casing including a converging outlet portion adjacent said discharge outlet, and an inner, coaxially disposed tubular member with inner and outer portions which divides the nozzle interior into an inner core chamber and an outer jacket chamber, said tubular member having an inlet end with an outwardly diverging inlet end surface on the outer portion thereof for splitting said liquid into a core stream which passes through said core chamber as well as a jacket stream which passes through said jacket chamber and for causing a stepwise increase in the ratio of the cross-sectional area of the core stream relative to the jacket stream in the direction of flow, said tubular member having an inner wall which intersects with said inlet end surface at an angle of about 15° to 45°, said inner tubular member also having an outlet end with an outwardly diverging outlet end surface on the inner portion thereof for recombining said core stream and jacket stream and for causing a further stepwise increase in the ratio of the cross-sectional area of the core stream relative to that of the jacket stream in the direction of flow, said tubular member having an outer wall which intersects with said outlet end surface at an angle of about 15° to 45°, said inlet end surface, outlet end surface, core chamber and jacket chamber being related in size and particularly in cross-sectional area for decreasing the jacket area at the inlet end surface by a percentage in the range of about 5 to about 20%, for increasing the core area at the outlet end surface by a percentage in the range of about 10 to about 30% and for increasing the ratio of velocity of the jacket stream relative to the core stream to a given value at said inlet end surface and for further increasing said ratio to a still larger value at said outlet end surface, whereby the recombined core and jacket streams will be discharged from the discharge outlet as a transversally contained jet with said radial speed gradient.

2. A nozzle according to claim 1 wherein said inner wall and inlet end surface intersect in a sharp edge.

3. A nozzle according to claim 1 wherein said outer wall and outlet end surface intersect in a sharp edge.

4. A nozzle according to claim 1 wherein the size relationships of the inlet end surface and jacket chamber and of the outlet end surface and core chamber are such that the total percentage change in jacket area and core area in said stepwise increases is about 40% or less.

5. A nozzle according to claim 1 wherein the tubular member has an outer diameter and the casing has an inner diameter such that the ratio of said outer diameter to said inner diameter is in the range of about 0.6 to about 0.8.

6. A nozzle according to claim 1 wherein said tubular member has a wall thickness and said casing has an inner diameter such that the ratio of said wall thickness to said inner diameter is in the range of about 0.02 to 0.04.

7. A nozzle according to claim 1 wherein said core chamber and jacket chamber have cross-sectional areas such that the ratio of core stream area to jacket stream area intermediate the inlet and outlet ends of said inner tube is in the range of about 0.5 to about 2.

* * * * *